US006916148B2

(12) United States Patent
Brown et al.

(10) Patent No.: US 6,916,148 B2
(45) Date of Patent: Jul. 12, 2005

(54) LOAD HANDLING VEHICLE

(75) Inventors: David John Brown, Uttoxeter (GB); Roy William Allsopp, Uttoxeter (GB); David Burrage, Cheadle (GB)

(73) Assignee: J. C. Bamford Excavators Ltd., Staffordshire (GB)

( * ) Notice: Subject to any disclaimer, the term of this patent is extended or adjusted under 35 U.S.C. 154(b) by 0 days.

(21) Appl. No.: 10/312,181

(22) PCT Filed: Jun. 27, 2001

(86) PCT No.: PCT/GB01/02851

§ 371 (c)(1),
(2), (4) Date: Feb. 25, 2003

(87) PCT Pub. No.: WO02/01009

PCT Pub. Date: Jan. 3, 2002

(65) Prior Publication Data

US 2003/0156937 A1 Aug. 21, 2003

(30) Foreign Application Priority Data

Jun. 27, 2000 (GB) ..... 0015579

(51) Int. Cl.[7] ..... B66F 9/00

(52) U.S. Cl. ..... 414/685; 180/68.1; 180/330; 414/680

(58) Field of Search ..... 414/680, 685, 414/700; 180/68.1, 329, 330, 331, 292

(56) References Cited

U.S. PATENT DOCUMENTS

| | | | | | |
|---|---|---|---|---|---|
| 3,726,428 | A | * | 4/1973 | Lark et al. | 414/700 |
| 3,963,132 | A | | 6/1976 | Dufour | |
| 4,999,022 | A | * | 3/1991 | Veys | 414/718 |
| 5,687,809 | A | | 11/1997 | Braud | |
| 5,816,351 | A | * | 10/1998 | Akira et al. | 180/68.1 |
| 5,836,733 | A | * | 11/1998 | Moses et al. | 414/685 |
| 5,964,567 | A | | 10/1999 | Bamford | |
| 6,056,502 | A | * | 5/2000 | Takemura et al. | 414/686 |
| 6,071,066 | A | | 6/2000 | Braud | |

FOREIGN PATENT DOCUMENTS

| | | |
|---|---|---|
| DE | 1759912 | 9/1971 |
| EP | 0 937 827 | 8/1999 |
| FR | 2696199 | 4/1994 |

* cited by examiner

*Primary Examiner*—Donald W. Underwood
(74) *Attorney, Agent, or Firm*—MacMillan, Sobanski & Todd, LLC

(57) ABSTRACT

A load handling vehicle having an operator's position, a power operated load handler including a boom pivotally mounted at a front end of the vehicle and at least front and rear pairs of ground engaging wheels with one wheel of each pair on each side of the vehicle. At least one pair of wheels is power driven. The operator's position is offset to one side of the pivotal mount for the boom. The operator's position may include a seat which can be moved between a first position on a longitudinal center line of the vehicle and a second position to one side of the vehicle center line.

26 Claims, 12 Drawing Sheets

LOAD HANDLING VEHICLE

DESCRIPTION OF INVENTION

This invention relates to a load handling vehicle, hereinafter referred to as being of the kind specified, comprising a structure having a load handling means at a front end of the vehicle, power means to raise said load handling means, ground engageable propulsion means comprising a pair of front ground engageable wheels disposed one at each side of the vehicle and a pair of rear ground engageable wheels disposed one at each side of the vehicle, an operator's position, an engine to provide power for said propulsion means to drive at least one of said pairs of wheels and for said power means to raise the load handing means, said engine being disposed towards the front pair of wheels.

The invention is particularly concerned with a vehicle of the kind specified which is used for load handling in construction and like activities comprising an operator's position disposed in a cab, with the load handling means located forwardly of the cab, and conventionally comprising a bucket or similar, and a further load handling means comprising a backhoe loader disposed rearwardly of the cab.

Conventionally such vehicles have a large enclosure disposed forwardly of the operator's cab and centrally of the vehicle, in which is located said engine and, forwardly thereof, a cooling means comprising a cooling fan and a radiator for coolant liquid of the engine through which air is drawn by the fan. The forward load handling means is mounted on a pair of generally parallel arms pivotally attached forwardly of the cab and extending one either side of the enclosure. Such a configuration suffers from obstructed lines of sight when the operator is attempting to operate the forward load handling means. In particular, the operator cannot see the load handling means when it is in its lowered position.

An aim of the invention is to provide a new or improved load handling vehicle.

According to a first aspect of the invention, we provide a load handling vehicle of the kind specified wherein the load carrying means is mounted on a boom pivotally mounted to the structure forwardly of the operator's position.

Said boom may be disposed on the longitudinal center line of said vehicle.

Alternatively, said boom may be offset from the longitudinal center line of said vehicle.

The center line of the boom may be offset by a distance in the range 0 mm to 275 mm from the longitudinal center line of the vehicle.

The vehicle may comprise cooling means which may be disposed at a side part of the vehicle.

The cooling means may be disposed at a side part of the vehicle between a front wheel and a rear wheel of the vehicle.

The cooling means may comprise a fan operable to draw air through a heat exchange means.

The heat exchange means may comprise one or more of an engine water coolant radiator, a hydraulic oil cooler, a transmission oil cooler and an air conditioning condenser.

The transmission oil cooler may comprise a torque converter oil cooler.

The cooling fan may be driven by a hydraulic motor.

The cooling means may comprise an enclosure having an upper wall, said upper wall comprising an inlet through which air is drawn by said fan.

The cooling means may comprise an enclosure having a side wall, said side wall having an aperture through which air is expelled from the interior of said enclosure by said fan.

The boom may comprise a mechanical self-levelling arm.

The boom may comprise a box section component.

The boom may comprise a telescopic boom.

The operator's position may comprise an operator's seat movable between a first position wherein the seat is located on the longitudinal center line of the vehicle and a second position wherein the seat is offset from the center line of the vehicle.

Said seat may pivotable about a vertical axis, said vertical axis being disposed away from the center line of said vehicle.

When the seat is in a first position, said seat may face generally rearwardly of the vehicle to permit the operator to operate a load handling means disposed rearwardly of the operator's position.

When the seat is in its second position, the seat may face generally forwardly of the vehicle to permit the operator to operate a load handling means disposed forwardly of the position.

When said boom is offset from the longitudinal centerline of the vehicle and when said seat is in its second position, said seat may be offset from the longitudinal center line of the vehicle on an opposite side of the center line to the boom.

The engine means may be disposed forwardly of the operator's position.

The engine may be disposed such that a vertical plane containing the longitudinal center line of the vehicle intersects the engine.

The engine may drive a transmission and the engine may be disposed wholly or partly below the operator's position.

The transmission may drive a hydraulic pump to provide fluid pressure.

The pump may be disposed below the operator's position.

A driver's line of sight may extend downwardly at an angle to the horizontal in the range 29° to 35° and preferably about 32° over a front part of the vehicle.

The uppermost part of the boom assembly may be disposed below a horizontal plane including the driver's eye level, preferably such that the driver can see downwardly over the uppermost part of the boom assembly at an angle to the horizontal in the range of 10° to 17° and preferably about 14°.

The invention will now be described by way of example with reference to the accompanying drawings, in which.

Figure 7:
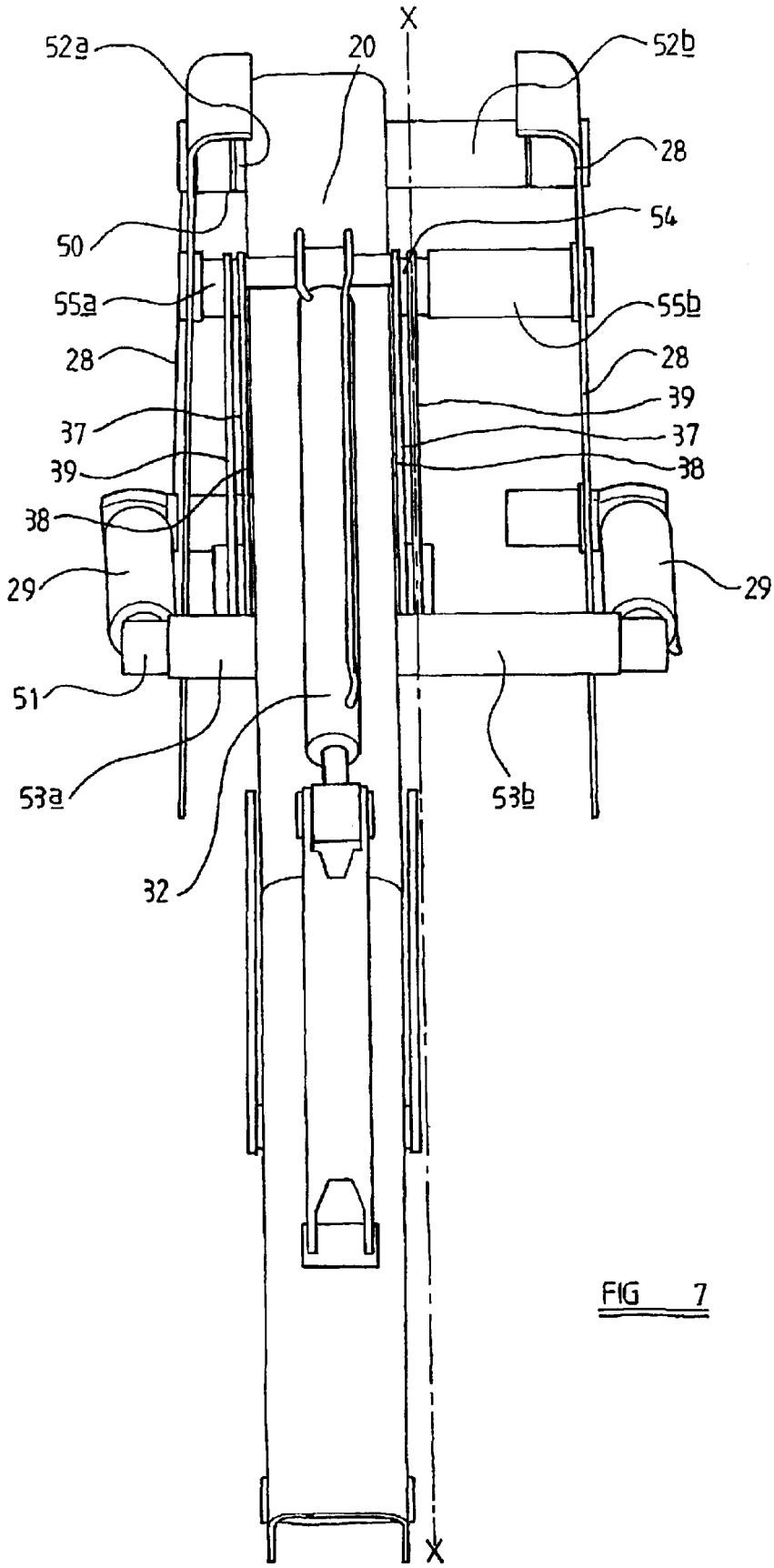
Figure 8:
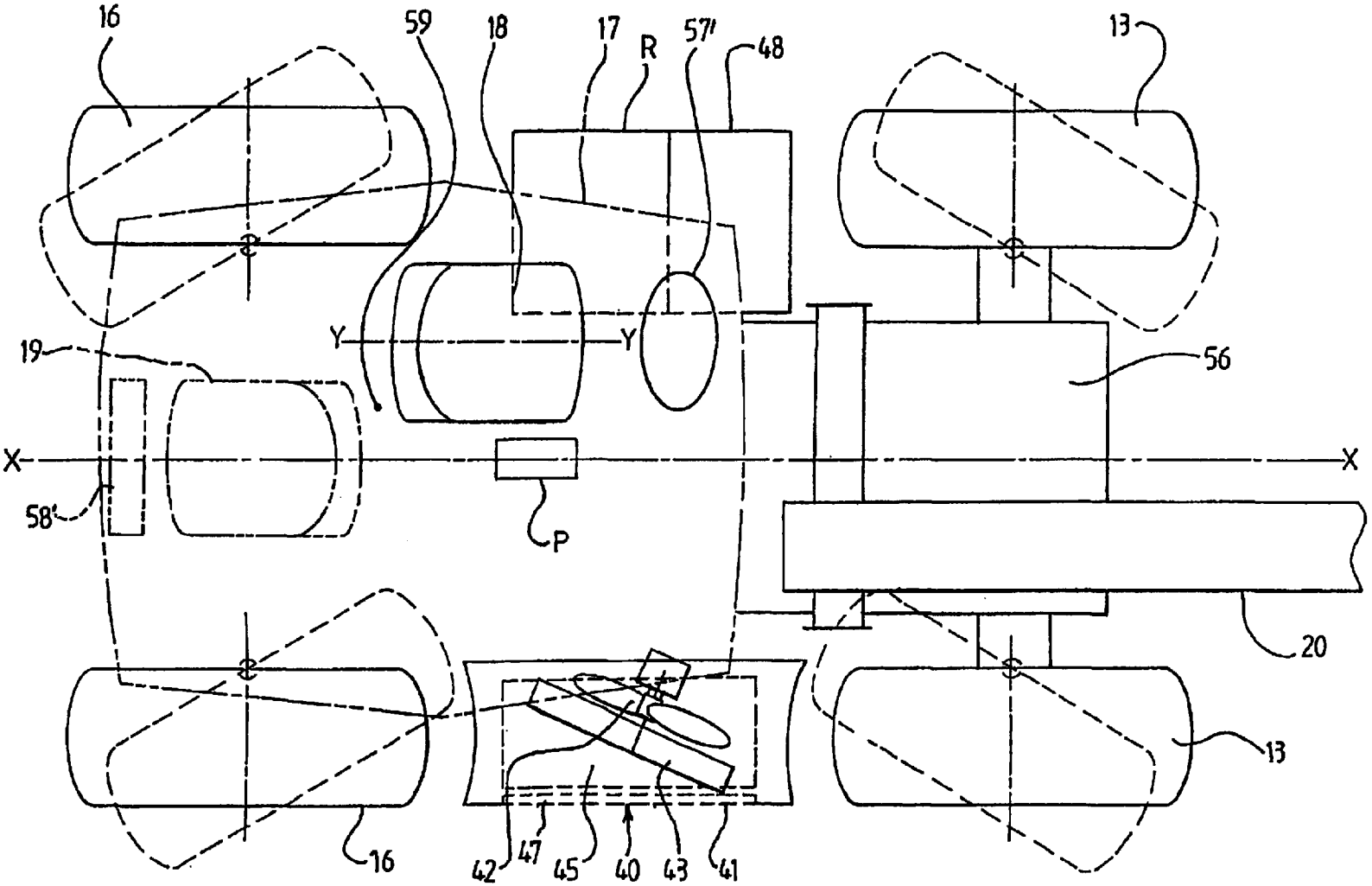
Figure 9:
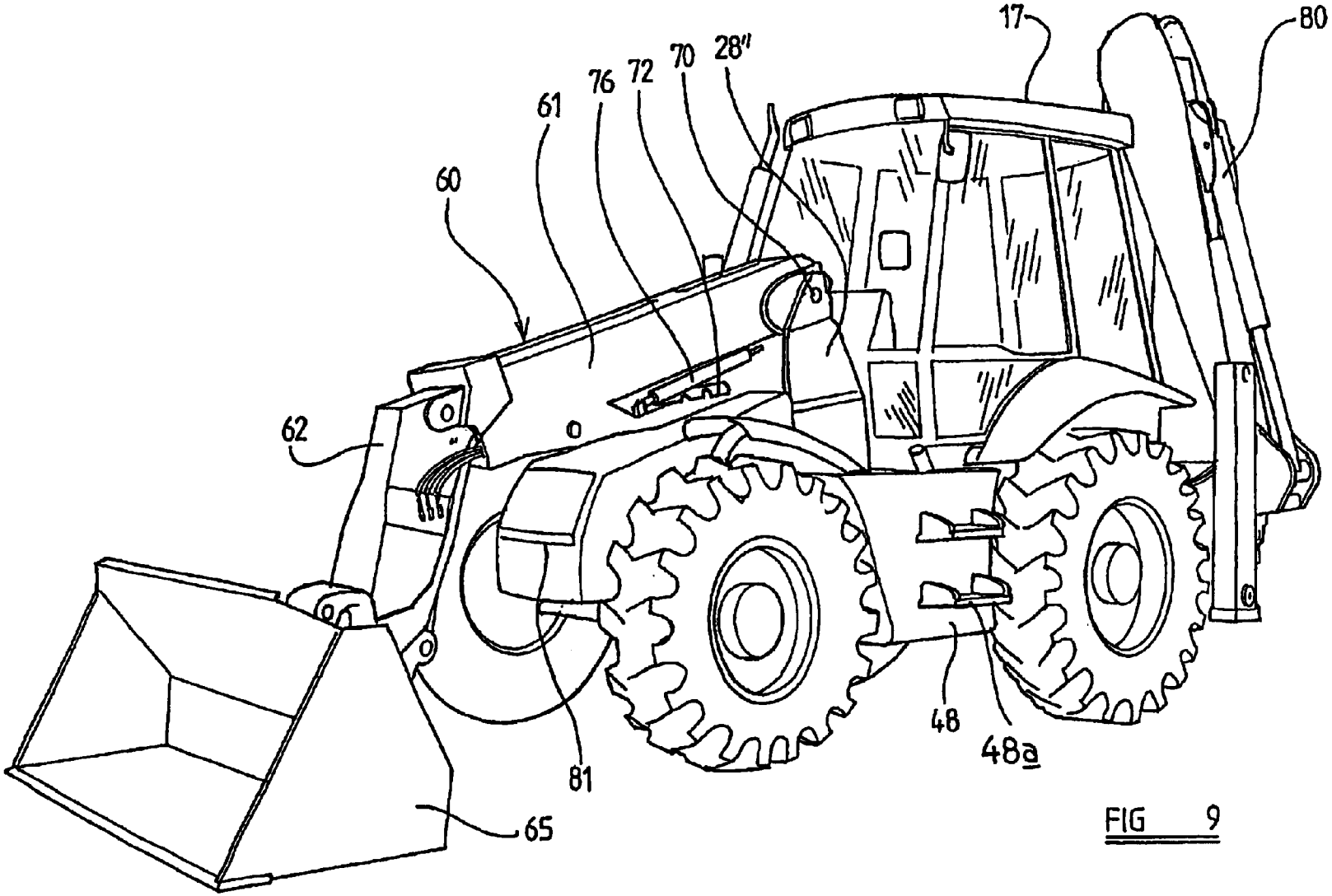
Figure 10:
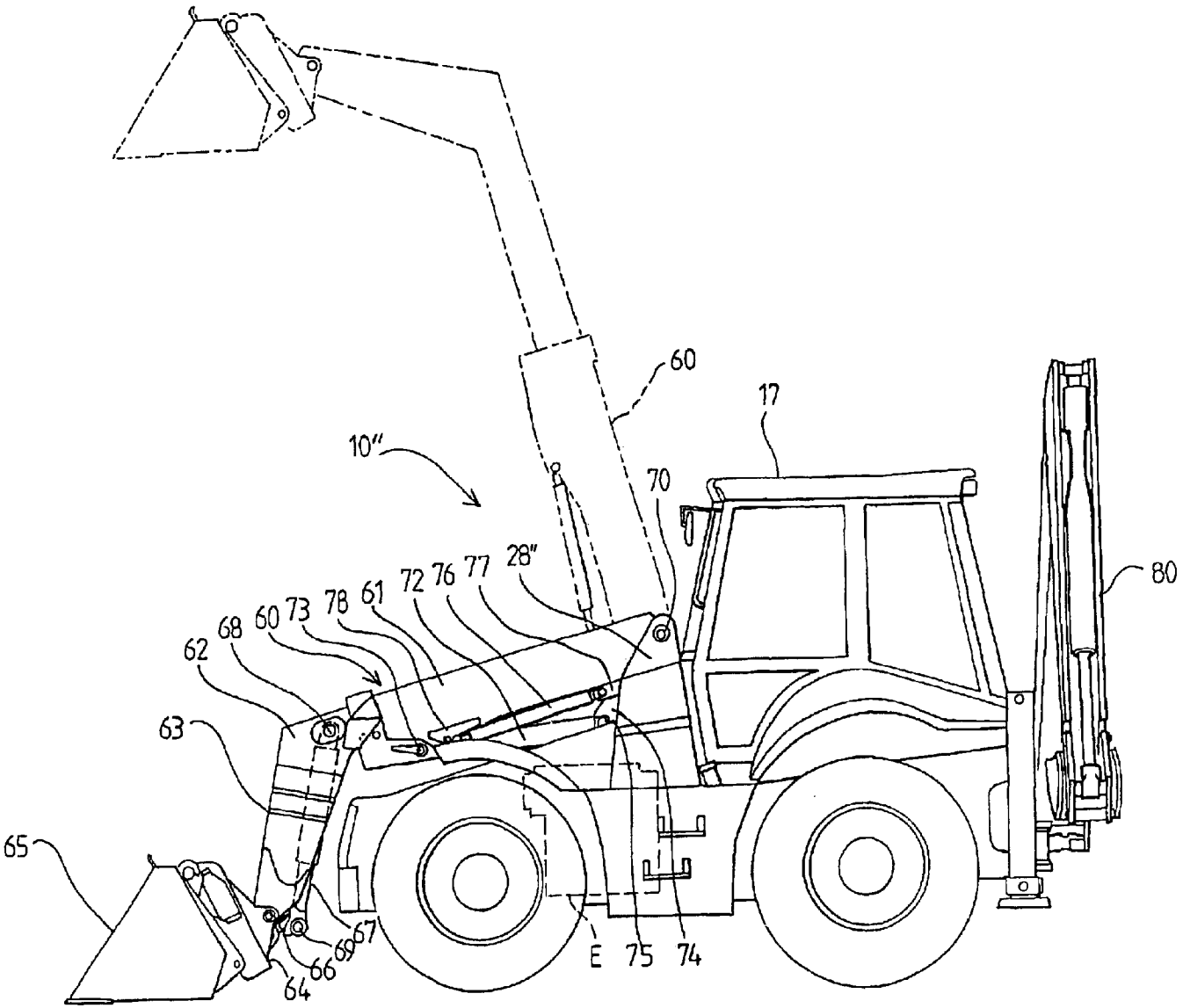
Figure 11:
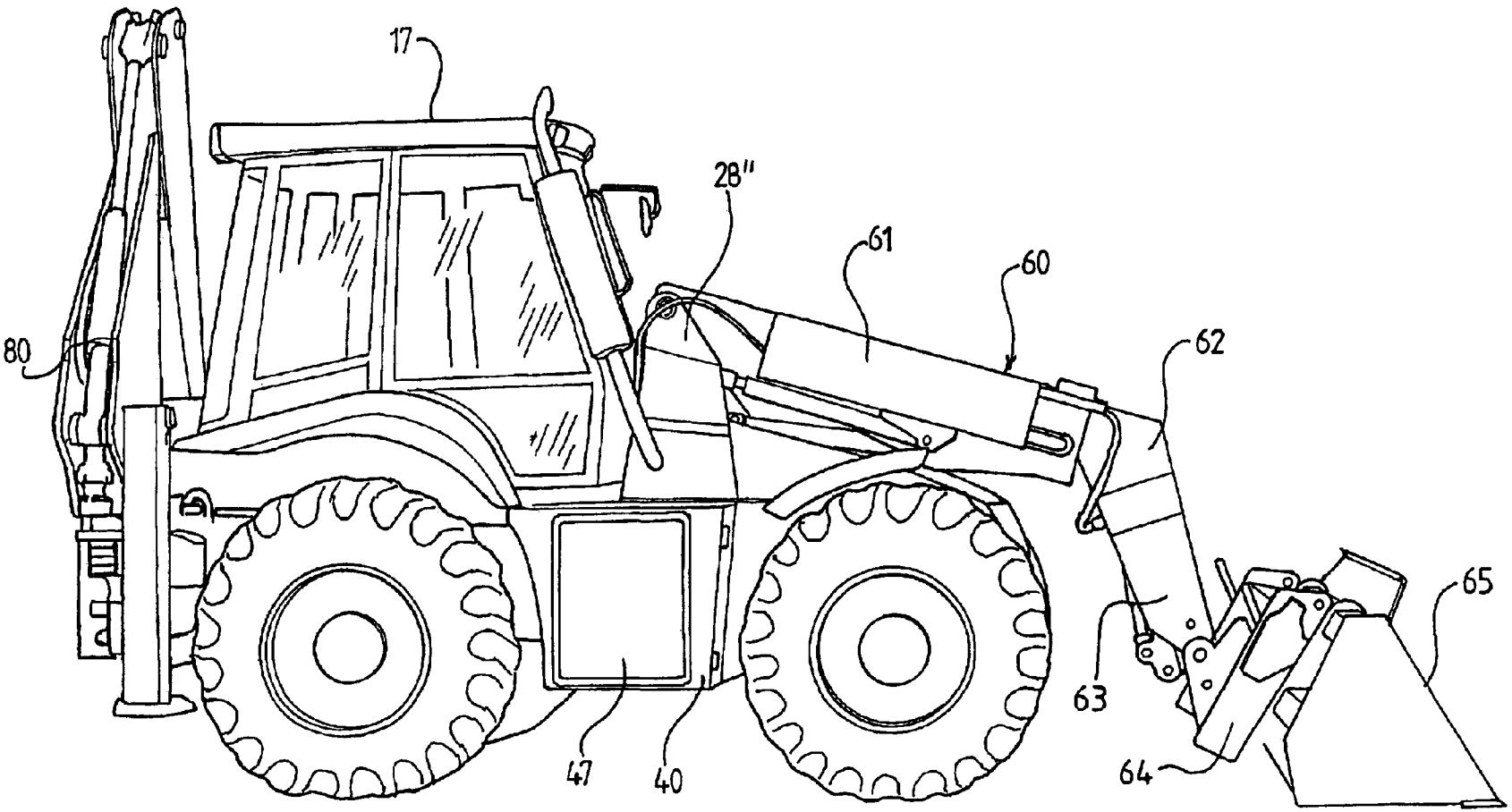
Figure 12:
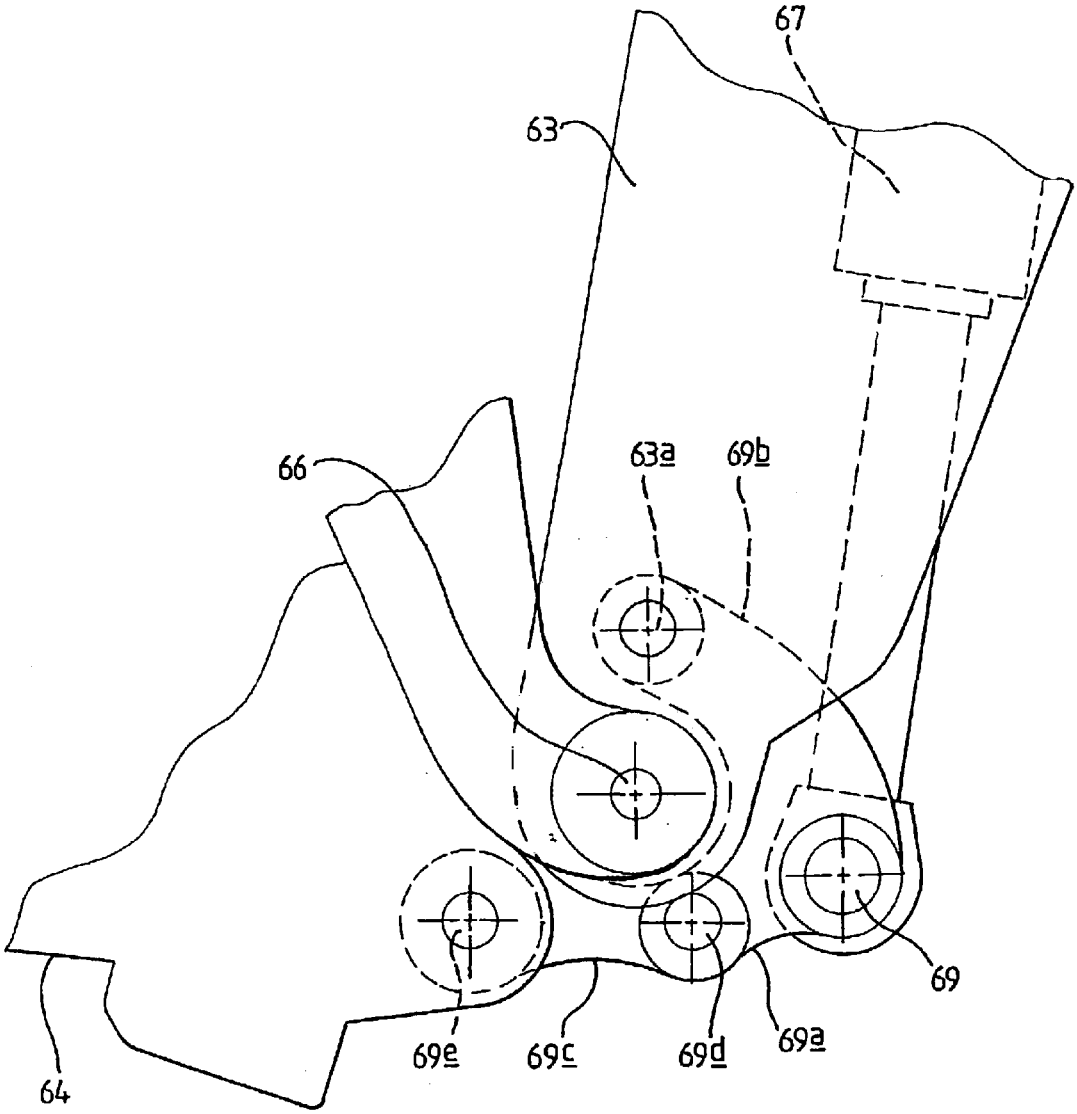

FIG. 7 is a front view of part of a chassis of a vehicle of an alternative configuration, FIG. 8 is a diagrammatic plan view of a vehicle of the alternative configuration of FIG. 7, FIG. 9 is a perspective view from the front and to the side of a further vehicle according to the present invention, FIG. 10 is a side view of the vehicle of FIG. 9, FIG. 11 is a further side view of the vehicle of FIG. 9, and FIG. 12 is a view of part of the vehicle of FIG. 9 on a larger scale.

Figure 1:
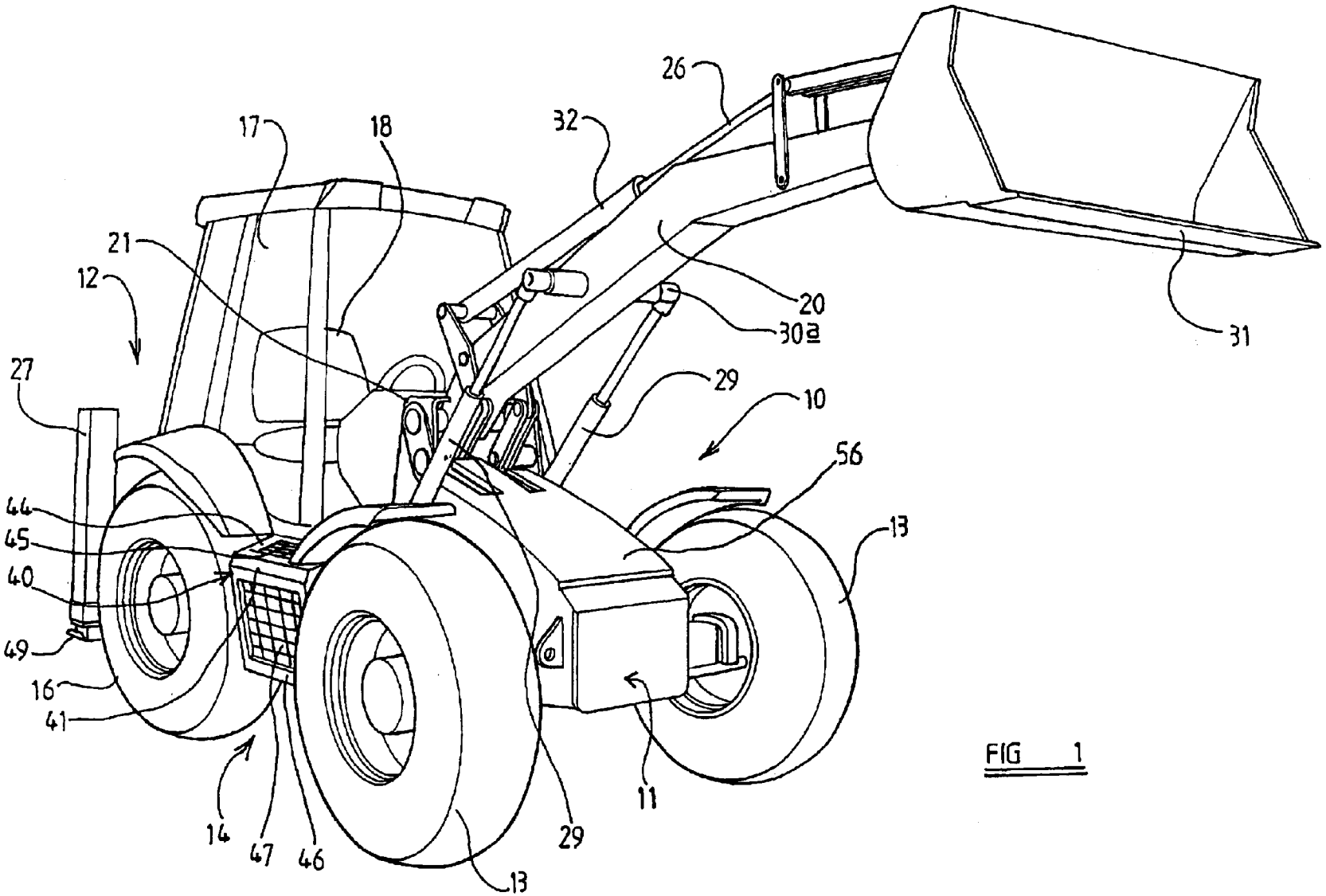
FIG. 1 is a perspective view from the front and to the side of a vehicle according to the present invention.
Figure 2:
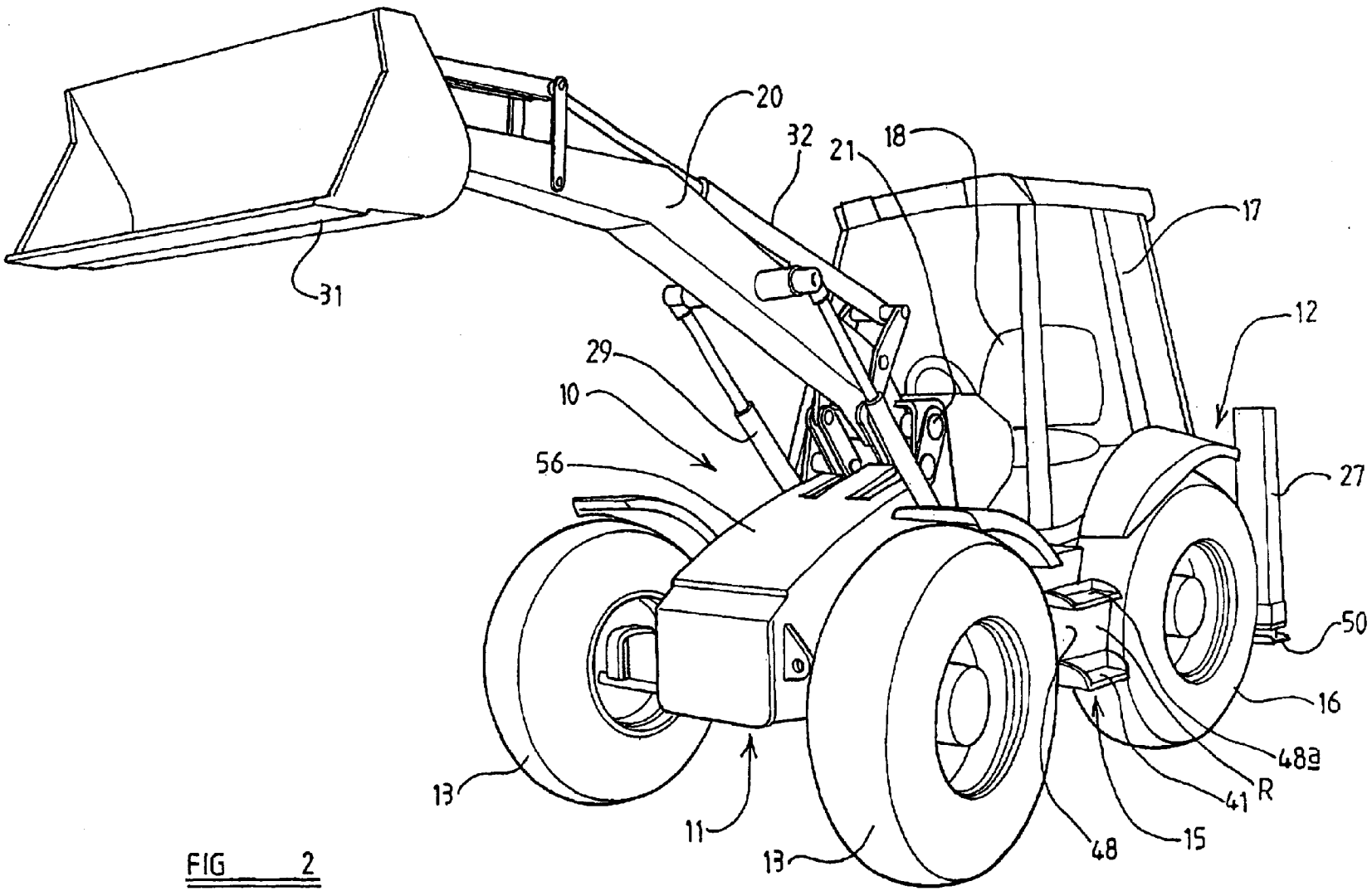
FIG. 2 is a perspective view from another direction of the vehicle of FIG. 1.
Figure 3:
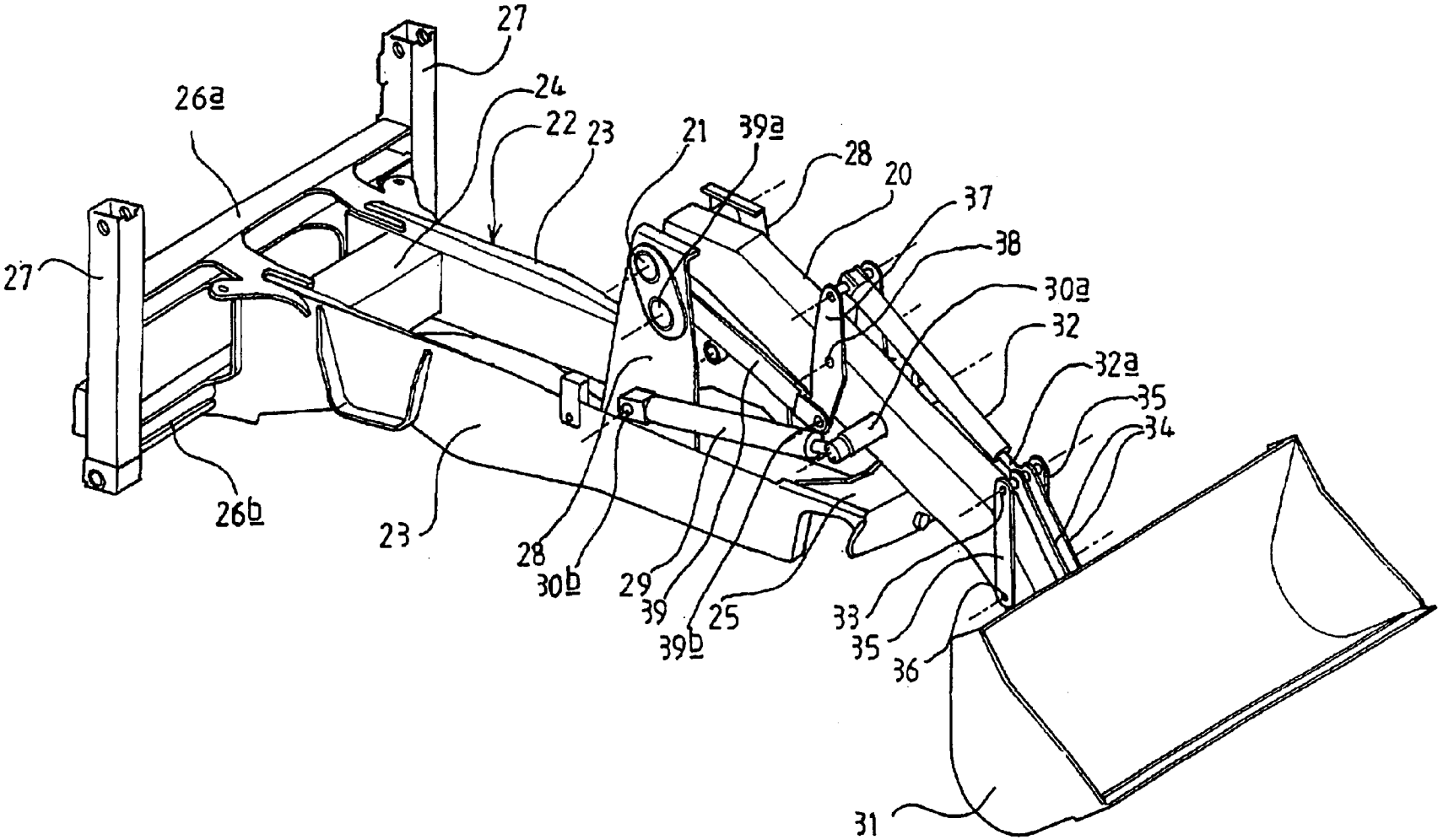
FIG. 3 is a perspective view of a chassis of the vehicle of FIG. 1.

The vehicles shown in FIGS. 4 to 8 and 9 to 11 differ in minor components from that shown in FIGS. 1 to 3, but in respects relevant to the present invention are similar to that of FIGS. 1 to 3 and, mutatis mutandis, features of any vehicle as described herein may be provided on another vehicle as described herein.

Referring now to FIGS. 1 and 2, a vehicle of the kind specified is shown at 10, comprising a forward region 11 and a rearward region 12. Disposed in the forward region 11 are a pair of front ground engageable wheels 13 which are spaced apart widthwise of the vehicle so as to be disposed one on either side 14, 15 of the vehicle. Similarly, in the rearward region 12 of the vehicle are provided a pair of rear ground engageable wheels 16 disposed widthwise of the vehicle so as to be disposed one at each side 14, 15 of the vehicle. Disposed generally towards the rear of the vehicle is an operator's position comprising an operator's cab 17 having an operator's seat 18. As shown in the plan view of FIG. 4, the operator's seat may be movable between two positions, a first position shown in dashed outline wherein the operator's seat faces in a rearward direction and a second position shown in solid outline where the operator's seat faces in a forward direction. A forward control position 57 is disposed forwardly of the cab, comprising means to drive the vehicle and operate the boom assembly 20, and a rearward control position 58 is disposed rearwardly of the cab to operate a rear load handling means (not shown). A boom assembly, comprising a boom 20 of conventional box section, is pivotally mounted on pivot means 21 disposed forwardly of the operator's cab 17. In the present example, the boom has a width of 250 mm.

As best seen in FIG. 3, the vehicle is provided with a chassis generally indicated at 22 comprising a pair of generally parallel longitudinally extending members 23. Said longitudinally extending members 23 are interconnected towards their rear end by a rear transverse connection member 24, in this example in the form of a box beam, and towards their forward ends by a forward transverse connection member 25. The longitudinally extending members 23 and the transverse connection members 24, 25 define a volume V therebetween which may wholly or partly receive an engine and transmission in a generally fore-and-aft configuration mounted in conventional manner.

Disposed attached to the rear ends of the longitudinally extending members 23 are a pair of generally parallel transversely extending guide means 26*a*, 26*b* spaced from one another in a vertical direction. The ends of the guide means 26*a*, 26*b* are connected by posts 27 to receive stabilising legs of conventional type. The guide means 26*a*, 26*b* may receive suitable load handling means mounted therein, such as a backhoe. Alternatively, a backhoe may be provided fixed rigidly relative to the vehicle, conventionally referred to as a "center mount".

Provided on the longitudinally extending members 23 at a position towards the, forward end thereof are a pair of upwardly extending, generally parallel members 28 between which the pivot means 21 extends to provide a mount for the boom 20. The operator's cab 17 is thus located on the longitudinally extending members 23 above the volume V and rearwardly of the upwardly extending members 28.

Figure 4:
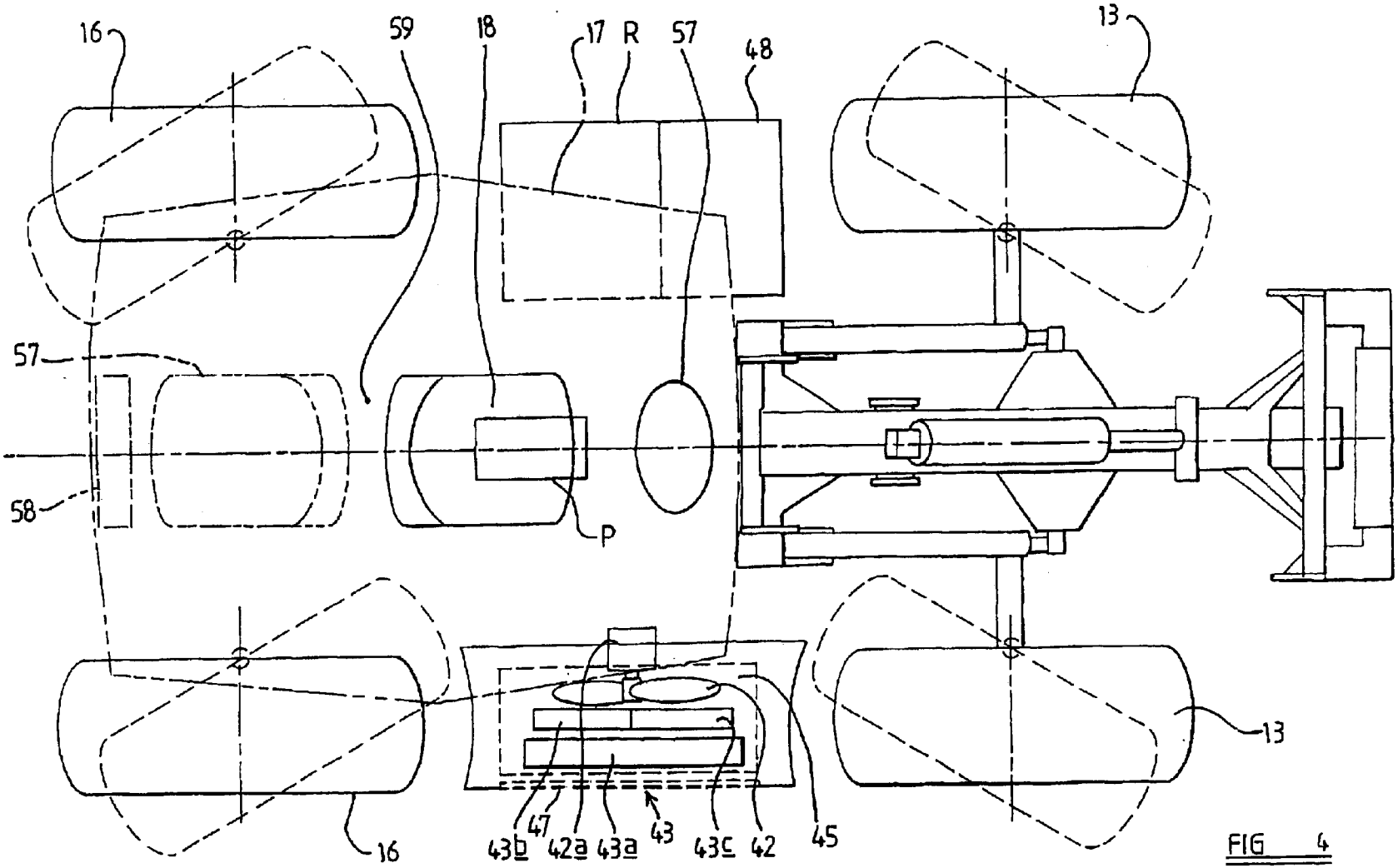
FIG. 4 is a diagrammatic plan view of a vehicle similar to the vehicle of FIG. 1.
Figure 5:
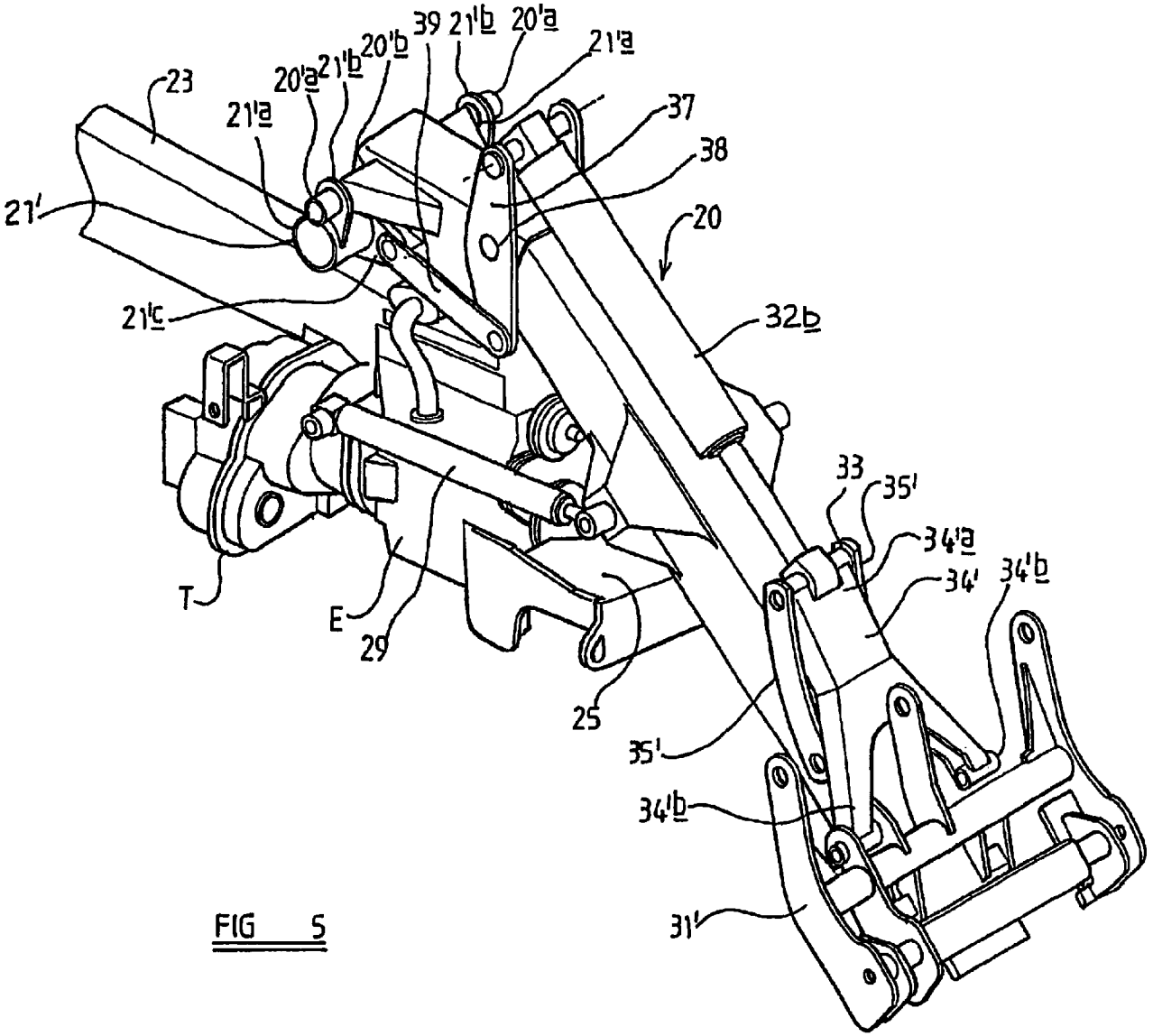
FIG. 5 is a partly cut away perspective view of part of a chassis of the vehicle of FIG. 4 showing an engine and transmission.
Figure 6:
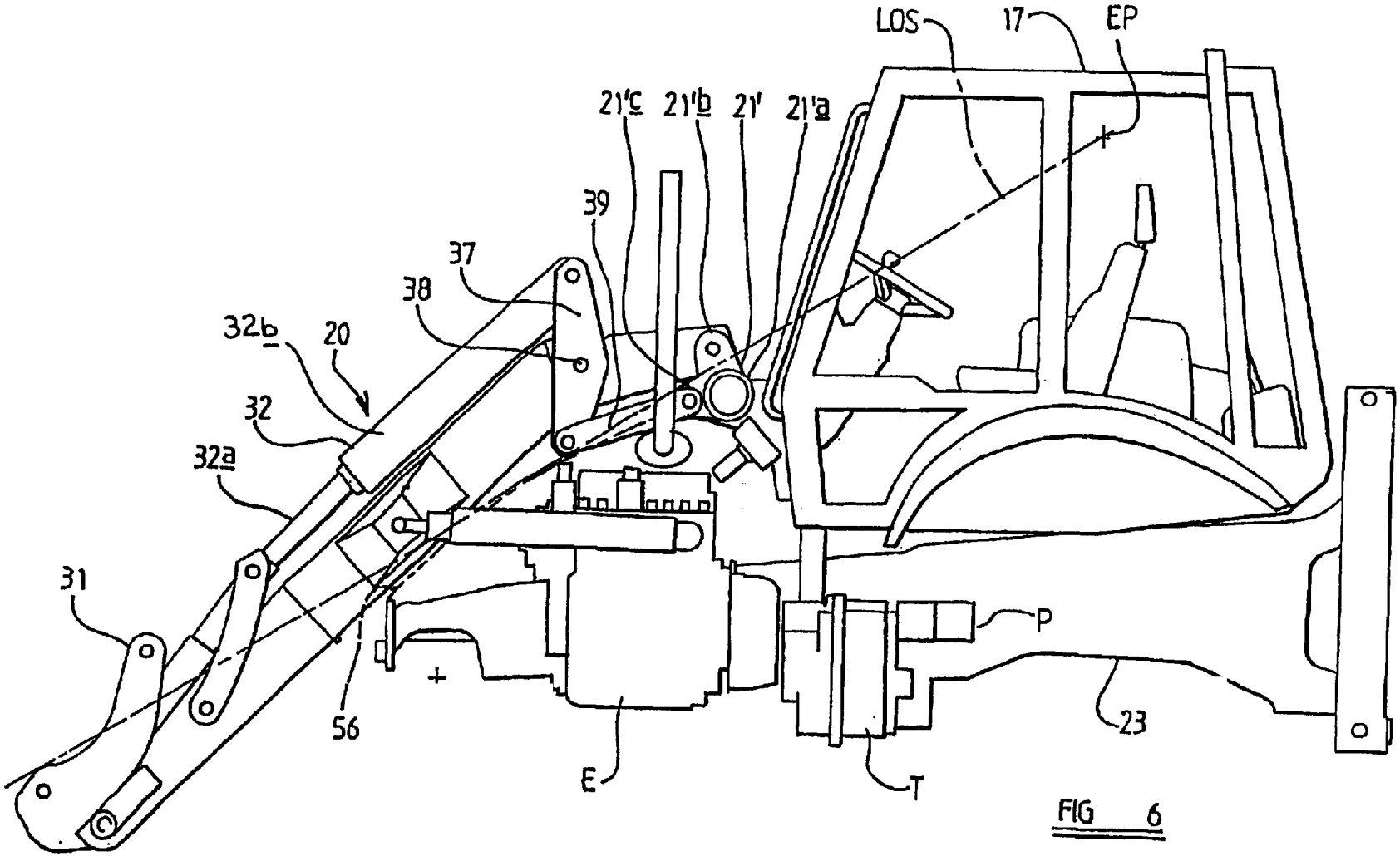
FIG. 6 is a partly cut away side view of the vehicle of FIG. 4.

A modification is shown in FIGS. 4 to 6. In these Figures a vehicle is shown in which a pivot means 21' comprises a generally cylindrical support member 21'*a* extending transversely of the vehicle. Disposed on the member 21'*a* are a pair of upwardly extending spaced ears 21'*b* and a pair of laterally spaced forwardly extending ears 21'*c*. The upwardly extending ears 21'*a* are provided with circular apertures, which receive generally cylindrical pivot elements 20'*a* extending transversely outwardly of the boom assembly 20. The boom assembly 20 further comprises generally triangular bracing elements 20'*b* attached to the boom assembly 20 and the pivot elements 20'*a*. When the fluid operated rams 29 are actuated, the boom assembly 20 pivots about the pivot elements 20'*a*. As seen in FIG. 5, the engine and transmission are disposed towards the front wheels in a forward part of the volume V, such that the major part of the engine is disposed below the boom assembly 20, while, as best seen in FIG. 6, the transmission is located beneath a forward part of the operator's cab 17.

Lift means comprising fluid operated rams 29 are pivotally attached by first pivot means 30*a* to the boom 20, and by second pivot means 30*b* to a lower part of the upwardly extending members 28. The boom 20 is provided with a material handling implement comprising, in the present example, a bucket 31 which is pivotally mounted on the boom 20 for pivotal movement relative thereto about a generally horizontal axis, such that the boom extends along a central axis of the bucket. Any suitable material handling implement may be provided as desired. Generally the bucket is generally disposed transversely of the vehicle and if a non-central position of the boom 20 is provided then the boom is correspondingly off set on the bucket.

A fluid pressure operated crowd ram means 32 is provided operable to pivot the bucket about said generally horizontal axis. The crowd ram means 32 is connected to the bucket 31 by way of a conventional self levelling system. A ram 32*a* of the crowd ram means 32 is connected by a pin 33 to a generally horizontal pair of bucket links 34 at one end thereof and a pair of generally parallel arm links 35 disposed outwardly of the bucket links 34. The bucket links 34 are pivotally connected at their other end to the bucket 31, whilst the boom links 35 extend alongside opposite faces of the boom 20 and are pivotably attached thereto by boom link connection means 36.

In the alternative configuration of FIGS. 4, 5 and 6, the bucket links 34 of the self-levelling system are replaced with a link assembly 34' of generally Y-shaped configuration. One end 34'*a* of the assembly 34' is attached to the crowd ram means 32 by a pin 33 and to a pair of curved boom links 35' generally equivalent to the boom links 35 of FIGS. 1 to 3. The pair of ends 34'*b* of the assembly 34' are pivotally attached to a material handling implement carrier 31' which may receive a fork or a bucket or any other material handling implement as desired. In both configurations a pair of transverse links 37 are disposed generally parallel to one another one either side of the boom and pivotally connected thereto by transverse link connection means 38 rearwardly of the first pivot means 30*a*. A cylinder 32*b* of the crowd ram means 32 is pivotally connected to an upper part of the transverse links 37. A pair of lower guide links 39 are disposed one either side of the boom and connected between first guide link pivot means 39*a* to the upwardly extending members 28, and at the other end by second guide link connection means 39*b* to a downwardly extending part of the transverse links 37. In the variant shown in FIGS. 4 to 6, the forwardly extending ears 21'*c* receive the first guide link pivot means 39*a*.

Hydraulic fluid for use in the vehicle, for example, in the rams and hydraulic motor hereinbefore described is provided from a hydraulic reservoir R and is pressurised by a hydraulic pump P disposed beneath the operator's seat 18 or, where the operator's seat is offset, as shown in FIG. 8 on the longitudinal axis of the machine but at a level below the level of the seat 18. In either case the hydraulic pump P is driven by the engine E. If desired the hydraulic reservoir may be disposed in another suitable position on the vehicle.

Disposed at one side 14 of the vehicle is a cooling means 40 comprising an enclosure 41 located between the forward wheel 13 and rear wheel 16 on the side 14 of the vehicle 10. Disposed within the enclosure 41 is, as best seen in FIG. 4, a fan 42 rotated by a hydraulic motor 42*a* to draw air through a heat exchange means 43. The axis of rotation of the fan 42 is inclined to the longitudinal axis of the vehicle at an angle of 90° but which may lie at any other angle as desired, for example as shown in FIG. 8. In each case the heat exchange means 43 is disposed transversely to the axis of rotation of the fan 42. The heat exchange means in the present example comprises an engine water coolant radiator 43*a*, a hydraulic oil cooler 43*b*, a transmission cooler comprising a torque converter oil cooler 43*c*. It may also comprise other components such as an air conditioning condenser. If desired one or more of the above mentioned components may be omitted, or alternatively disposed in front of the engine E but so as to not or not significantly affect the height of the cowling 56.

The enclosure 41 is provided with an upper wall 44 in which a first aperture 45 provided with a grille is located. The enclosure 41 further comprises a side wall 46 in which a second aperture 47 provided with a grille is located. The apertures 45, 47 are disposed relative to the fan 42 such that air is drawn in through the first aperture 45, urged through the heat exchange means 43 and expelled through the second aperture 47. Such a configuration is particularly advantageous in that, for example, any spray of water from the wheels will not be drawn into the first aperture 45. Alternatively, air may be drawn in through the second aperture 47, urged through the heat exchange means 43 and expelled through the first aperture 45 if desired.

On the opposite side 15 of the vehicle 10, a fuel tank 48 and reservoir R for hydraulic fluid is disposed between the front wheel 13 and rear wheel 16. The tank 48 is provided with steps 48*a* for an operator attached to the outside thereof. The operator's cab 17 is disposed centrally of the vehicle 10 and at least partly above the fuel tank 48. The operator's cab 17 is provided with a door for the operator on the same side 15 of the vehicle as the fuel tank 48, and preferably no door is provided on the same side 14 of the vehicle 10 as the cooling means 40. The cooling means 40 and fuel tank 48 are attached to an outer face of the respective longitudinally extending member 23.

A forward cowling 56, is provided over the forward part of the chassis beneath the boom 20. Since the heat exchange means 43 are disposed at the side 14 of the vehicle 10, the forward cowling 56 is not restricted by a requirement to accommodate the cooling means. The cowling 56 is thus shaped to curve downwardly in a forward direction so as to permit the boom 20 to be lowered to a lowermost desired position as seen in FIG. 6 and to provide a substantially improved line of sight forwardly and downwardly of the vehicle for an operator in the operator's cab 17.

As best shown in FIG. 6 the driver's line of sight LOS is thus defined by the height of the driver's eye level, the height of that part of the cowling 56 which is tangential to the driver's line of sight, and the horizontal distance between the driver's eye position EP and the tangential point of the cowling 56. The driver's line of sight tangential to the cowling 56 thus makes an angle with the horizontal given by arctan $$\left(\frac{H1-H2}{D1}\right),$$

where H1 is the height of the driver's eye position above the ground, H2 is the height of the tangential point of the cowling 56 above the ground and D1 is the horizontal distance between vertical plane perpendicular to the longitudinal axis of the vehicle containing the driver's eye position and the tangential point of the cowling. Assuming the material handling vehicle is on perfectly level ground, the nearest point on the ground the driver can see over the engine cowling 56 is a distance D2=

$$\left(\frac{D1\cdot H1}{H1-H2}\right)$$

forwardly of the vertical plane comprising the driver's eye position. In the present example, H1 is about 2.49 m, H2 is about 1.33 m and D1 is about 1.86 m, but these dimensions may vary, for example, H1 may vary by ±10 cm from 2.49 m. The driver can therefore see downwardly over the cowling 56 at an angle in the range 29° to 35° to the horizontal in the present example about 32°, and can see the ground at a point D2 is about 3.4 m ahead of his eye position. In conventional machines, with the engine disposed in a higher and more forward direction and with the cooling means disposed forwardly of the engine, the view forward of the driver is clearly substantially more obstructed. The view afforded to the driver is also only limited by a relatively narrow boom, 250 mm in this instance relative to the width of the engine cowling, 800 mm in this example, affording the driver a substantially improved forward and downward view as the driver can see the implement to either side of the boom.

This improved field of view thus allows the driver to see a significant part of the bucket 31 or other material handling implement 31', and as will be apparent from FIG. 6 in which the line of sight LOS is marked.

When the boom is in its lowered position, for example for travelling on the road, it is further desirable that the driver be able to see as far ahead as possible over the top of the boom assembly 20. In the present example, the height of the highest part of the boom assembly is below the horizontal plane comprising the driver's eye position. The driver can thus see downwardly at an angle defined by arctan $$\left(\frac{H1-H3}{D3}\right),$$

where H1 is the vertical height of the driver's eye position above the ground, H3 is the height of the highest part of the boom assembly above the ground level and D3 is the horizontal distance between the vertical plane perpendicular to the longitudinal axis of the vehicle comprising the driver's eye position and the highest part of the boom assembly 20 and again, assuming the vehicle is disposed on level ground. The nearest point on the ground which can be seen over the highest point of the boom assembly 20 is a distance D4 given by $$\left(\frac{D3 \cdot H1}{H1 - H3}\right).$$

In the present example, H3 is about 2.04 m and D3 is about 1.85 m. The driver can therefore see the ground over the top of the lowered boom assembly 20 at a point about 10.2 m ahead of the vertical plane comprising the driver's eye position and can see downwardly at an angle in the range 10° to 17° to the horizontal, in the present in the present example about 14°.

In the present example, the driver's eye position EP is at a height of about 0.67 m above a datum level, in the present example a seat index point defined in accordance with ISO standard 5253. In the present example, the seat index point is about 1.77 m above ground level when the seat is in the lowermost position. The height of the seat 18 is variable in the present example over a range of about 6.5 cm. In the example calculations, EP is about 2.49 m above ground level. The driver's eye position is selected such that with variation in driver height and seat level, it is expected that a majority of drivers will have an eye position within the range of ±10 cm of EP.

Disposed at the rear of the vehicle are a pair of stabilising legs 49 of conventional nature slidably received in the posts 27.

In the vehicles of FIGS. 1 to 6, the boom 20 is provided disposed along the longitudinal center line of the vehicle. However, it may be desirable to locate the boom 20 in a position offset from the longitudinal center line X of the vehicle 10. In an alternative configuration shown in FIGS. 7 and 8, the boom 20 is located between the upwardly extending members 28 as discussed above, and is connected to lift means comprising a pair of fluid operated rams 29 as before. The boom 20 is pivotally mounted on a first pivot pin 50 extending between the upwardly extending members 28. A second transverse pivot pin 51 extends between an end part of each fluid operated ram 29 and the boom 20. The pivot pins 50, 51 are received in bosses 52*a*, 52*b*, 53*a*, 53*b* of unequal length disposed one either side of the boom 20 such that the boom 20 is offset from the center line of the vehicle in a leftward direction as seen in FIG. 7. The crowd ram means 32 and the self levelling means are mounted on the boom as described herein with reference to the vehicles of FIGS. 1 to 6. The only alteration required to provide a self levelling means on an offset boom is that the guide links 39 as shown in FIG. 3 are connected to the upwardly extending members 28 by a guide link pivot pin 54 extending between the upwardly extending members 28. First and second spacers 55*a*, 55*b* respectively of equal lengths are disposed on the pivot pin 54 to maintain the guide links 39 in an offset position.

Such an offset position of the boom results in an improved line of sight for an operator to observe the operation of the forward load handling means, since the operator can view the forward load handling means from a position away from the longitudinal axis of the boom and at an angle thereto and hence has a view of the forward load handling means substantially unobstructed by the boom.

The downward angle of vision of the drive is still constrained by the height of the point of the cowling 56 which is tangential to the driver's line and vision, but the offset location of the boom permits with improved forward view of the load handling mean along the longitudinal axis of the vehicle.

Further, the operator's position may be offset from the center line X. As best seen in FIG. 8, the operator's seat 18 is movable between two positions, a first position shown in dashed outline wherein the operator's seat 18 faces in a generally rearwards direction, and a second position shown in solid outline wherein the operator's seat 18 faces in a generally forward direction. A forward control means 57' is disposed offset from center line of the vehicle such that it is disposed generally forwardly of the operator's seat 18 when the operator's seat 18 is in its second position. Advantageously, as seen in FIG. 8, the operator's seat 18 when in its second position is offset from the center line X of the vehicle on the opposite side thereof to the boom 20.

Where a rear load handling means is provided, for example a side shift backhoe provided on the guide means 26*a*, 26*b*, a rearward control means 58' to control said rear load handling means is preferably provided such that the rearward control means 58' is provided generally rearwardly of the vehicle from the operator's seat 18 when in its first position. To permit the operator's seat 18 to move between a first position disposed generally on the center line X of the vehicle and a second position offset from the center line X of the vehicle, operators seat 18 is pivotable about a vertically extending axis 59 at a point halfway between the center line X of the vehicle and a center line Y of the operator's seat 19. When the operator's seat 19 is pivoted about axis 59 to move from its second position to its first position, the offset of the axis 59 from the center line X of the vehicle and the offset of the center line Y of the seat 18 from the axis 59 cancel such that when the operator's seat 18 is in its first position, the center line Y of the seat 18 is located over the center line X of the vehicle.

Although the boom 20 is shown as a conventional box section one piece boom, it will be apparent that the boom may comprise, for example, a telescopic boom in which box section components are telescopically disposed as described herein with reference to FIGS. 9 to 11, or any other suitable boom as appropriate. It will be apparent that the boom 20 may be located on the center line X of the vehicle, or offset therefrom as desired.

It will apparent that the operator's seat 18 may be disposed in a fixed position or may be pivotable between two or more alternative positions, and is pivotally connected to the implement carrying means 64 by second link pivot 69*e* that said fixed position or one or more of said alternative positions may be located on the center line of the vehicle or offset therefrom as desired. It will further be apparent that cooling means 40 as shown located on a side of the vehicle 10 may be provided on any desired material handling vehicle, and not simply a vehicle with a forwardly extending boom located forwardly of the operator's cab 17. If desired the engine may be disposed in another desired position such as rearwardly of the operator's position.

Referring to FIGS. 9 to 12, as discussed hereinbefore a vehicle according to the present invention may be provided with a telescopic boom as appropriate. In FIGS. 9 to 12, a vehicle 10" embodying the present invention is shown provided with a telescopic boom 60. The vehicle 10" is substantially the same as the vehicle of FIGS. 1–6 with the exception of the provision of the boom 60. The boom 60 comprises a rearward portion 61 and a forward portion 62 telescopically received within the rearward portion 61 in conventional manner. An extension ram (not shown) is provided between the boom portions 61 and 62 within the rearward portion 61 and is operable to move the forward portion 62 telescopically relative to the rearward portion 61 in conventional manner. The forward portion 62 comprises a transversely extending portion 63 at an end thereof, which depends downwardly from the forward boom part 62 when the boom 60 is in its lowered position as shown in FIG. 10. Provided on the transversely extending portion 63 is an implement carrying means 64 operable to receive a desired load handling implement as appropriate, in the present example a bucket 65. The implement carrying means 64 is pivotally connected to a transversely extending part pivot means 66 for pivotable crowding movement about a generally horizontal axis. A crowd ram means generally indicated at 67 is mounted within the transversely extending part 63 connected between a boom pivotal connection 68 and an implement pivotal connection 69. The implement pivotal connection 69 is provided on a first link part 69*a* provided with a limb part 69*b* pivotally connected to the transversely extending portion at pivot means 63*a*. The first link part 69*a* is pivotally connected to a second link part 69*c* by a first link pivot 69*d*, and the second link part 69*c* is pivotally connected to the implement carrying means 64 by a second link pivot 69*e*.

The crowd ram means 67 is operable by supply of fluid under pressure thereto in conventional manner to act on the first link part 69*a* and second link part 69*c* to cause pivotal movement of the implement carrying means 64.

The boom 60 is pivotally mounted on the vehicle 10" by a pivot means 70. The pivot means 70 extends between a pair of upwardly extending generally parallel members 28" substantially identical to the upwardly extending generally parallel members 28 shown in FIG. 3. To raise and lower the boom 60, a lift ram means 72 is provided disposed beneath the rearward portion 61 connected between a boom lift pivotal connection 73 provided on the boom 70 and a pivotal lift connection 74 provided fixed relative to the chassis, in the present example provided in a pair of forwardly extending ears 75 attached to the upwardly extending generally parallel members 28". The lift ram means 72 is operable to raise the boom to its raised position as shown in dashed outline in FIG. 10 by a supply of fluid under pressure thereto in conventional manner.

A pair of compensation rams 76 are provided, one located either side of the boom 60. The compensation rams 76 are each provided connected between a forwardly extending ear 77 of the respective vertically extending member 28" and a downwardly extending ear 78 connected to the rearward portion 61 of the boom 60. The compensation rams 76 are in fluid flow communication with the crowd ram means 67 in conventional manner, such that the bucket 65 or other load handling implement carried by the boom 60 maintains its orientation relative to the ground as the boom 60 is raised or lowered.

As seen in FIGS. 9 to 11 the vehicle 10" is provided with a rear backhoe assembly 80 of conventional type.

With reference to the arrangement of the engine E, cooling means 40 and fuel tank 48, it will be apparent that the disposition of these elements is the same as or substantially the same as described hereinbefore with reference to the earlier embodiments. This disposition of the engine E, cooling means 40 and fuel tank 48 thus permits the boom 60 to be located forwardly of the operator's cab 17, in the present example along the longitudinal axis of the vehicle. Due to the location of the lift ram 72 below the rearward boom part 61, it is necessary that the pivot 70 is disposed at a somewhat higher vertical position than the pivots 21, 21' of FIGS. 1–3 and 4–6. Nevertheless, it will be apparent that this configuration provides the same advantages as the embodiments described hereinbefore, in that the driver's view of the bucket 65 and forwardly of the vehicle is substantially unobstructed by the boom 60.

As shown in FIG. 9, the vehicle 10" is provided at a forward part thereof with a scavenger air inlet 81 to provide some air flow over the engine E. The scavenger air inlet 81 is entirely passive, in that there is no fan or radiator mechanism provided but in some circumstances a small fan may be provided to cause air to flow over a turbo charger of the engine. The engine cooling functions are performed by the cooling means 40 as described hereinbefore.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A load handling vehicle comprising a structure having a load handling means at a front end of the vehicle, power means to raise said load handling means, ground engagable propulsion means comprising a pair of front ground engageable wheels disposed one at each side of the vehicle and a pair of rear ground engageable wheels disposed one at each side of the vehicle, an operator's position, an engine to provide power for said propulsion means to drive at least one of said pairs of wheels and for said power means to raise the load handling means, said engine being disposed towards the front pair of wheels, wherein the load handling means comprises a boom pivotally mounted to the structure forwardly of the operator's position, wherein said boom has a center line and the center line of the boom is offset from the longitudinal center line of said vehicle.

2. A vehicle according to claim 1, the engine being disposed such that a vertical plane containing the longitudinal center line of the vehicle intersects the engine, and wherein the engine drives a transmission, the transmission being disposed wholly or partly beneath the operator's position.

3. A vehicle according to claim 1 wherein cooling means are disposed at one side of the vehicle.

4. A vehicle according to claim 3 wherein the cooling means is disposed at a side part of the vehicle between the front wheel and the rear wheel of that side of the vehicle.

5. A vehicle according to claim 3 wherein the cooling means comprises a fan operable to draw air through a heat exchange means.

6. A vehicle according to claim 3 wherein the heat exchange means comprises one or more of an engine water coolant radiator, a hydraulic oil cooler, a transmission oil cooler and an air conditioning condenser.

7. A vehicle according to claim 5 wherein the cooling fan is driven by a hydraulic motor.

8. A vehicle according to claim 5 wherein said cooling means comprises an enclosure having an upper wall, said upper wall comprising an inlet through which air is drawn by said fan.

9. A vehicle according to claim 5 wherein said cooling means comprises an enclosure having a side wall, said side wall having an aperture through which air is expelled from the interior of said enclosure by said fan.

10. A vehicle according to claim 1 wherein the boom comprises a mechanical self-leveling system.

11. A vehicle according to claim 1 wherein the boom comprises a telescopic boom.

12. A vehicle according to claim 1 wherein the operator's position comprises an operator's seat pivotable about a vertical axis between a first position wherein the seat is located on the longitudinal center line of the vehicle and a second position wherein the seat is offset from the center line of the vehicle.

13. A vehicle according to claim 12 wherein said vertical axis being disposed away from the center line of said vehicle.

14. A vehicle according to claim 12 wherein, when the seat is in a first position, said seat faces a rearward control means to permit the operator to operate a load handling means disposed rearwardly of the operator's position.

15. A vehicle according to claim 12 wherein, when the seat is in its second position, the seat faces a forward control means to permit the operator to operate a load handling means disposed forwardly of the operator's position.

16. A vehicle according to claim 15 wherein the boom is offset from the longitudinal center line of said vehicle where said seat, when in its second position, is offset from the longitudinal center line of the vehicle on an opposite side of the center line to the boom.

17. A vehicle according to claim 2 wherein the transmission drives a hydraulic pump to provide fluid pressure.

18. A vehicle according to claim 17 wherein the pump is disposed below the operator's position.

19. A vehicle according to claim 1 wherein the vehicle comprises a cowling extending over a front part of the vehicle, the vehicle comprising a seat index point defining a driver's eye position at a point 0.67 m above the seat index point, wherein the cowling is disposed such that a driver's line of sight extending downwardly from the driver's eye position over the cowling to the ground defines an angle to the horizontal in the range 29° to 35° and preferably about 32°.

20. A vehicle according to claim 1 wherein the vehicle comprises a seat index point defining a driver's eye position at a point 0.67 m above the seat index point, and wherein an uppermost part of the boom assembly is disposed below a horizontal plane including the driver's eye position.

21. A vehicle according to claim 20 wherein the uppermost part of the boom axially is disposed below the horizontal plane including the driver's eye position such that a driver's line of sight extending from the driver's eye position downwardly over the uppermost part of the boom assembly to the ground defines at an angle in the range 10° to 17° to the horizontal and preferably about 14°.

22. A vehicle according to claim 1 wherein the center line of the boom is offset by a distance no more than 275 mm from the longitudinal center line of the vehicle.

23. A load handling vehicle comprising a structure having a load handling means at a front end of the vehicle, power means to raise said load handling means, ground engagable propulsion means comprising a pair of front ground engageable wheels disposed one at each side of the vehicle and a pair of rear ground engageable wheels disposed one at each side of the vehicle, an operator's position, an engine to provide power for said propulsion means to drive at least one of said pairs of wheels and for said power means to raise the load handling means, said engine being disposed towards the front pair of wheels, wherein the load handling means comprises a boom pivotally mounted to the structure forwardly of the operator's position, wherein the operator's position comprises an operator's seat movable between a first position wherein the seat is located on the longitudinal center line of the vehicle and a second position wherein the seat is offset from the center line of the vehicle, said seat being pivotable about a vertical axis, said vertical axis being disposed away from the center line of said vehicle.

24. A vehicle according to claim 23 wherein, when the seat is in the first position, said seat faces a rearward control means to permit the operator to operate a load handling means disposed rearwardly of the operator's position.

25. A vehicle according to claim 23 wherein, when the seat is in its second position, the seat faces a forward control means to permit the operator to operate a load handling means disposed forwardly of the operator's position.

26. A vehicle according to claim 23 wherein the boom is offset from the longitudinal center line of said vehicle and wherein said seat, when in its second position, is offset from the longitudinal center line of the vehicle on an opposite side of the center line to the boom.

* * * * *